US008083105B2

(12) United States Patent
Reichert et al.

(10) Patent No.: US 8,083,105 B2
(45) Date of Patent: Dec. 27, 2011

(54) PRESSURIZED FLUID DELIVERY SYSTEM

(76) Inventors: Lucas C. Reichert, Pleasant Grove, UT (US); Gabriel G. Reichert, Lehi, UT (US); Toby Hazelbaker, Pleasant Grove, UT (US)

( * ) Notice: Subject to any disclaimer, the term of this patent is extended or adjusted under 35 U.S.C. 154(b) by 152 days.

(21) Appl. No.: 12/367,241

(22) Filed: Feb. 6, 2009

(65) Prior Publication Data

US 2009/0140005 A1 Jun. 4, 2009

Related U.S. Application Data

(63) Continuation-in-part of application No. 11/497,672, filed on Aug. 1, 2006, now abandoned, which is a continuation-in-part of application No. 11/026,225, filed on Jan. 3, 2005, now abandoned, and a continuation-in-part of application No. 11/026,224, filed on Jan. 3, 2005, now abandoned.

(51) Int. Cl.
*B65D 35/28* (2006.01)

(52) U.S. Cl. ..... 222/175; 222/95; 222/386.5; 222/107; 224/148.2; 220/703; 383/3; 383/40; 383/906

(58) Field of Classification Search ..... 222/94–96, 222/175, 386.5, 105, 107, 209; 224/148.1, 224/148.2, 148.4–148.6; 220/703, 705, 710; 383/3, 38–46, 66, 67, 107, 109, 906
See application file for complete search history.

(56) References Cited

U.S. PATENT DOCUMENTS 4,267,834 A 5/1981 Barger et al.
4,626,243 A 12/1986 Singh et al.
4,651,360 A * 3/1987 Wang ..... 4/506
4,869,402 A 9/1989 Ash
4,903,859 A * 2/1990 Derby et al. ..... 383/41
4,921,143 A 5/1990 Billet
5,059,182 A 10/1991 Laing
5,060,833 A 10/1991 Edison et al.
5,419,772 A 5/1995 Teitz et al.
5,492,219 A * 2/1996 Stupar ..... 206/219

(Continued)

FOREIGN PATENT DOCUMENTS

WO WO2009/064907 5/2009

OTHER PUBLICATIONS www.mistymate.com/hmpsport.html (accessed Jul. 15, 2004) HydraMistPak? Sport by Misty Mate?/h1>.

(Continued)

*Primary Examiner* — J Casimer Jacyna
(74) *Attorney, Agent, or Firm* — Maschoff Gilmore & Israelsen

(57) ABSTRACT

A flexible fluid delivery system comprising a fluid bladder having a first inlet and a first outlet, the fluid bladder configured to contain liquid, an inflatable compartment capable of being pressurized by inflation and having a second inlet, the inflatable component being formed adjacent to the fluid bladder, such that the fluid bladder and the inflatable component are integrated to form a pressurized fluid reservoir, a seam element formed in the fluid bladder and the inflatable component of the pressurized fluid reservoir, the seam element being capable of controlling the shape of the pressurized fluid reservoir, a pump associated with the second inlet of the inflatable compartment, the pump being configured to inflate the inflatable component of the pressurized fluid reservoir, and a valve operatively coupled to the first outlet of the fluid bladder, the valve being capable of releasing the liquid contained in the fluid bladder.

20 Claims, 4 Drawing Sheets

U.S. PATENT DOCUMENTS

| | | | | |
|---|---|---|---|---|
| 5,535,951 | A | 7/1996 | Utter | |
| 5,564,605 | A | 10/1996 | Heidbreder | |
| 5,620,140 | A | 4/1997 | Utter | |
| 5,622,056 | A | 4/1997 | Utter | |
| 5,738,657 | A | 4/1998 | Bryant et al. | |
| 5,775,590 | A | 7/1998 | Utter | |
| 5,846,446 | A * | 12/1998 | Jackson | 249/110 |
| 5,913,456 | A | 6/1999 | Dikeman | |
| 5,940,880 | A | 8/1999 | Phillips | |
| 6,220,755 | B1 * | 4/2001 | Brown et al. | 383/119 |
| 6,344,146 | B1 | 2/2002 | Moorehead et al. | |
| 6,409,048 | B1 | 6/2002 | Belzeski | |
| 6,427,873 | B2 * | 8/2002 | Wilcox | 222/95 |
| 6,887,379 | B2 | 5/2005 | Schiltz | |
| 6,981,613 | B1 | 1/2006 | Kamisugi | |
| 7,044,343 | B2 | 5/2006 | Anue | |
| 7,806,300 | B1 * | 10/2010 | Noell et al. | 222/175 |
| 2006/0144862 | A1 | 7/2006 | Reichert et al. | |
| 2006/0144863 | A1 | 7/2006 | Reichert et al. | |
| 2006/0243765 | A1 | 11/2006 | Valeriana | |
| 2007/0012733 | A1 | 1/2007 | Horito | |
| 2008/0029561 | A1 | 2/2008 | Reichert et al. | |
| 2008/0308578 | A1 * | 12/2008 | Skillern et al. | 222/209 |
| 2009/0179046 | A1 | 7/2009 | Reichert et al. | |
| 2010/0044396 | A1 * | 2/2010 | Skillern | 222/209 |

OTHER PUBLICATIONS

Wikipedia, the free encyclopedia, water treatment and water purification (accessed Nov. 12, 2007), 13 pages.

Wikipedia, the free encyclopedia, portable water purification (accessed Nov. 12, 2007), 2 pages.

Wikipedia, the free encyclopedia, reverse osmosis (accessed Nov. 12, 2007), 8 pages.

Life Medical Supplier, Hospira Pressure Infusion Cuff (accessed Nov. 26, 2008) 6 pages.

U.S. Appl. No. 11/026,224, Sep. 13, 2007, Office Action.

U.S. Appl. No. 11/026,225, Sep. 13, 2007, Office Action.

U.S. Appl. No. 11/497,672, Nov. 23, 2009, Office Action.

* cited by examiner

PRESSURIZED FLUID DELIVERY SYSTEM

CROSS-REFERENCE TO RELATED APPLICATIONS

This application is a continuation-in-part of U.S. patent application Ser. No. 11/497,672 filed Aug. 1, 2006, which claims priority to U.S. patent application Ser. No. 11/026,225 filed on Jan. 3, 2005 and U.S. patent application Ser. No. 11/026,224 filed on Jan. 3, 2005, which applications are incorporated herein by reference in their entirety.

BACKGROUND OF THE INVENTION

1. The Field of the Invention

The present invention relates to a hydration system. More specifically, the present invention relates to a method and system of pressurizing a hydration system.

2. The Relevant Technology

Bicyclists, hikers, runners, walkers and other athletes often use hydration packs to maintain adequate hydration while engaging in their sports. These hydration packs usually have a bag like fluid reservoir, or bladder that is disposed in a pack that can be carried by the user. A long flexible hose can connect to the reservoir and may provide a mouthpiece for the user. The mouthpiece can be carried in the user's mouth to allow the user to draw or suck liquid from the reservoir as desired.

These types of hydration packs can be problematic because they depend on hydrostatic head pressure and suction to move fluid from the flexible container through the tube and mouthpiece. Hydrostatic head pressure is the pressure resulting in the hose from the weight of the liquid in the hydration pack. Often this hydrostatic head pressure is inadequate to move a sufficient amount of fluid to quench the user's thirst. Consequently, these types of hydration packs may also require suction by the user through the mouthpiece to provide adequate flow of fluid to the user. Providing the amount of suction force is difficult, if not impossible, for many users, especially when the user is engaged in a vigorous activity such as cycling, running, or the like.

Another problem of these suction type hydration packs is that the amount of fluid drawn from the reservoir is directly proportional to the amount of sucking force applied. Consequently, a considerable amount of force may be needed to draw a sufficient amount of water to quench a user's thirst and meet the user's hydration needs. This is especially problematic when the user is short of breath because of participating in a strenuous activity.

Some hydration packs have pressurization systems to pressurize the liquid in the reservoir to overcome the sucking force problem. Most of these systems have a second flexible tube coupled between the reservoir and a pressure source, such as a pump. The user can actuate the pump in order to force air, or some other compressible gas into the reservoir, thereby pressurizing the reservoir with the pumped air. The pumped, pressurized air exerts pressure on the liquid and forces the liquid out of the flexible tube when the mouthpiece valve is activated by the user.

Unfortunately, these types of hydration packs work best when the pack is in an upright position since the liquid has to remain near the tube outlet in order to be pushed through the tube by the pressurized air. Moreover, as liquid is consumed, more pressurized air is required to maintain pressure on the liquid. Thus, many pressurization cycles may be needed to maintain enough pressure in the bladder to force the liquid through the tube. Additionally, when the pack nears an empty point, the pressurized air is often insufficient to force the remaining liquid out the tube.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

These and other limitations are overcome by embodiments of the invention which relate to systems and methods for storing and delivering a fluid from a fluid bladder. As described more fully below, the systems provide a method of pressurizing the fluid stored in the fluid bladder so that the fluid may be more easily delivered from the fluid bladder than in previous systems known in the art.

A first aspect of the invention is a flexible fluid delivery system. The system comprises a fluid bladder having a first inlet and a first outlet, the fluid bladder configured to contain liquid, an inflatable component capable of being pressurized by inflation and having a second inlet, the inflatable component being formed adjacent to the fluid bladder, such that the fluid bladder and the fluid bladder form an pressurized fluid reservoir, a seam element formed in the fluid bladder and the inflatable component of the integrated fluid delivery reservoir, the seam element being capable of controlling the shape of the pressurized fluid reservoir, a pump associated with the second inlet of the inflatable component, the pump being configured to inflate the inflatable component of the pressurized fluid reservoir, and a valve operatively coupled to the first outlet of the fluid bladder, the valve being capable of releasing the liquid contained in the fluid bladder of the pressurized fluid reservoir.

A second aspect of the invention comprises an pressurized fluid reservoir configured to hold and selectively dispense a liquid through an outlet. The pressurized fluid reservoir comprises a bladder portion configured to contain a liquid and having a first inlet capable of receiving the liquid and an outlet capable of dispensing the liquid, an inflatable portion formed adjacent to the bladder portion, the inflatable portion having a second inlet capable of receiving a gas so as to inflate and apply a pressure on the bladder portion formed adjacent to the inflatable portion, a seam element formed in the bladder portion and inflatable portion capable of controlling the shape of the bladder portion and inflatable portion, a pressure inducer associated with the second inlet of the inflatable portion being configured to inflate the inflatable portion by transferring a gas into the inflatable portion via the second inlet, and a valve operatively coupled to the first outlet of the bladder portion, to the valve being capable of releasing the liquid contained in the fluid bladder portion of the pressurized fluid reservoir.

A third aspect of the invention is a flexible fluid delivery system. The flexible fluid delivery system comprises a fluid bladder having a first inlet and a first outlet, the fluid bladder configured to contain liquid, an inflatable component capable of being pressurized by inflation and having a second inlet, the inflatable component being formed adjacent to the fluid bladder, such that the fluid bladder and the fluid bladder form an pressurized fluid reservoir, a seam element formed in the fluid bladder and the inflatable component of the integrated fluid delivery reservoir, the seam element being capable of controlling the shape of the pressurized fluid reservoir, a pump associated with the second inlet of the inflatable component, the pump being configured to inflate the inflatable component of the pressurized fluid reservoir, and a valve operatively coupled to the first outlet of the fluid bladder, the valve being capable of releasing the liquid contained in the fluid bladder of the pressurized fluid reservoir. In the flexible delivery system, the fluid bladder and the inflatable component are separated by a membrane wall, such that the membrane wall forms a wall of the fluid bladder and a wall of the inflatable component.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
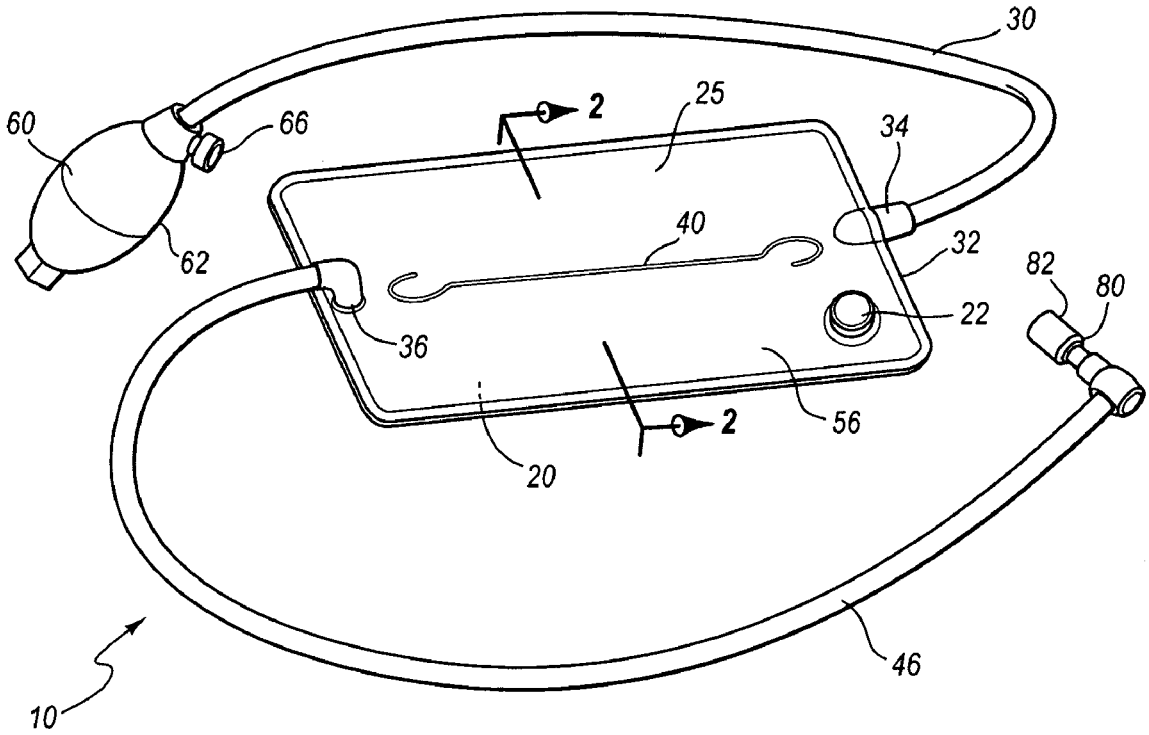
FIG. 1 is a perspective view of a pressurizable fluid delivery system in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. The following detailed description and exemplary embodiments of the invention will be best understood by reference to the accompanying drawings, wherein the elements and features of the invention are designated by numerals throughout.

The present invention is generally directed to a pressurizable fluid delivery system for delivering pressurized fluids to a user. For example, pressurized fluid can be useful in hydrating a person engaging in a strenuous activity, such as cycling, running, hiking or the like. Depending on the specific requirements of the environment where the system is being used, the pressurizable fluid delivery system can include a pressurized fluid reservoir such as a bladder that can be filled with a liquid such as water, electrolyte replacement fluids, energy drinks, or the like. Pressurized fluid can also be useful in cleaning equipment or gear. Furthermore, the pressurizable fluid delivery system described herein may be used to hydrate a pet or other animal.

A pressurizable portion of an integrated, flexible fluid delivery system can be disposed adjacent to the fluid bladder portion so that the pressurizable portion is capable of pressurizing the bladder. Thus, the pressurizable portion comprises a chamber that can be pressurized. Because the pressurized portion is disposed adjacent to the fluid bladder portion, the pressurized portion is capable of pressing against the fluid bladder portion when the pressurized portion is pressurized. The force of the chamber pressing against the fluid bladder portion can push the fluid in the fluid bladder portion toward an outlet in the fluid bladder portion. A valve can be operatively coupled to the fluid bladder portion so that fluid may be released from the bladder. Thus, the force of the pressurized portion pressing against the bladder portion can produce a pressurized liquid stream from the opened valve.

Advantageously, the pressurizable water delivery system of the present invention reduces the need for repressurizing the fluid bladder portion since the pressure from the pressurizable portion can provide an applied force against the fluid bladder portion even as the bladder is emptied. Additionally, the force applied by the pressurizable portion against the fluid bladder portion can result in a more even pressure on the fluid bladder portion which results in a more evenly pressurized liquid stream from the opened valve.

As illustrated in FIG. 1, a pressurizable fluid delivery system, indicated generally at 10, in accordance with an embodiment of the present invention is shown for use in providing a portable, pressurized stream of liquid from an integrated, pressurized fluid reservoir 56. The integrated, pressurized fluid reservoir 56 is comprised of a fluid bladder portion 25 and a pressurizable portion 20 which is disposed adjacent to the fluid bladder portion 25. The fluid bladder portion 25 may be filled with a desired liquid, such as water, an electrolyte replacement drink, or the like. A pressure inducer 60, such as a pump, can be operably coupled to the pressurizable portion to supply pressure to the pressurizable portion 20 of the pressurized fluid reservoir 56. The pressurizable fluid delivery system 10 can also include a valve 80 that can be operatively coupled to the fluid bladder portion 25 so as to selectively release fluid from the fluid bladder portion 25.

The pressurized fluid reservoir 56 may by comprised of a flexible plastic material suitable for containing both liquid fit for human consumption and an inflatable gas. In one embodiment described more fully below, the exterior of the pressurized fluid reservoir 56 is comprised of a durable flexible plastic material capable of resisting ripping or tearing, whereas an interior membrane 27 (shown in FIG. 2) of the pressurized fluid reservoir 56 which forms a dividing wall between the fluid bladder portion 25 and the pressurizable portion 20 is formed of a second plastic material.

The pressurized fluid reservoir 56 includes an inlet 22 and an outlet 36 which are connected to the fluid bladder portion 25 of the pressurized fluid reservoir 56. The inlet 22 can be sized and shaped to allow the fluid bladder portion 25 to be filled with the desired liquid and also with a cooling material, such as ice. A lid 28 can close and seal the inlet 22 to restrict leakage of the liquid. As may be understood by one of ordinary skill in the art, the precise location of the inlet is not limited and the inlet 22 may be disposed any number of locations in the pressurized fluid reservoir 56, including, but not limited to the seam 32 of the pressurized fluid reservoir 56, provided only that the inlet 22 is capable of allowing the fluid bladder portion 25 to be filled with a liquid.

The outlet 36 can be a hole positioned at an opposite end (or another location) of the fluid bladder portion 25 of the pressurized fluid reservoir 56 from the inlet 22. A flexible tube 46 can be coupled to the outlet 36 and can carry liquid from the fluid bladder portion 25 of the pressurized fluid reservoir 56 to a desired release location, such as a user's mouth. The valve 80 can close the end of the tube 46 to restrict fluid from leaking from the tube 46.

Figure 2:
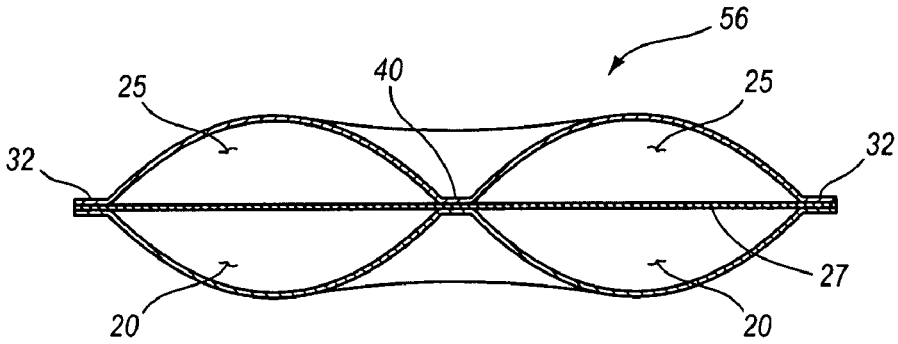
FIG. 2 is a cross section of the pressurizable fluid delivery system of FIG. 1, shown with an inflatable portion disposed adjacent to a fluid bladder.

As shown in FIG. 2, the exterior wall of the fluid bladder portion 25 comprises the exterior of the pressurized fluid reservoir 56 and may comprise a durable flexible plastic material, while the opposing, interior wall of the fluid bladder portion 25 comprises a dividing wall 27 comprised of a flexible plastic which separates the fluid bladder portion 25 from pressurizable portion 20.

The pressurizable portion 20 of the pressurized fluid reservoir 56 is formed adjacent to the fluid bladder portion 25. As shown in FIG. 2, the pressurizable portion 20 comprises a chamber that is capable of being pressurized. As shown in FIG. 2, the exterior wall of the pressurizable portion 20 comprises the exterior of the pressurized fluid reservoir 56 and may comprise a durable flexible plastic material, while the opposing, interior wall of the pressurizable portion comprises a dividing wall 27 comprised of a flexible plastic which separates the pressurizable portion 20 from the fluid bladder portion 25. Alternatively, the dividing wall 27 may be comprised of the same material as the exterior wall of the pressurizable portion 20 and the fluid bladder portion 25.

Figure 3:
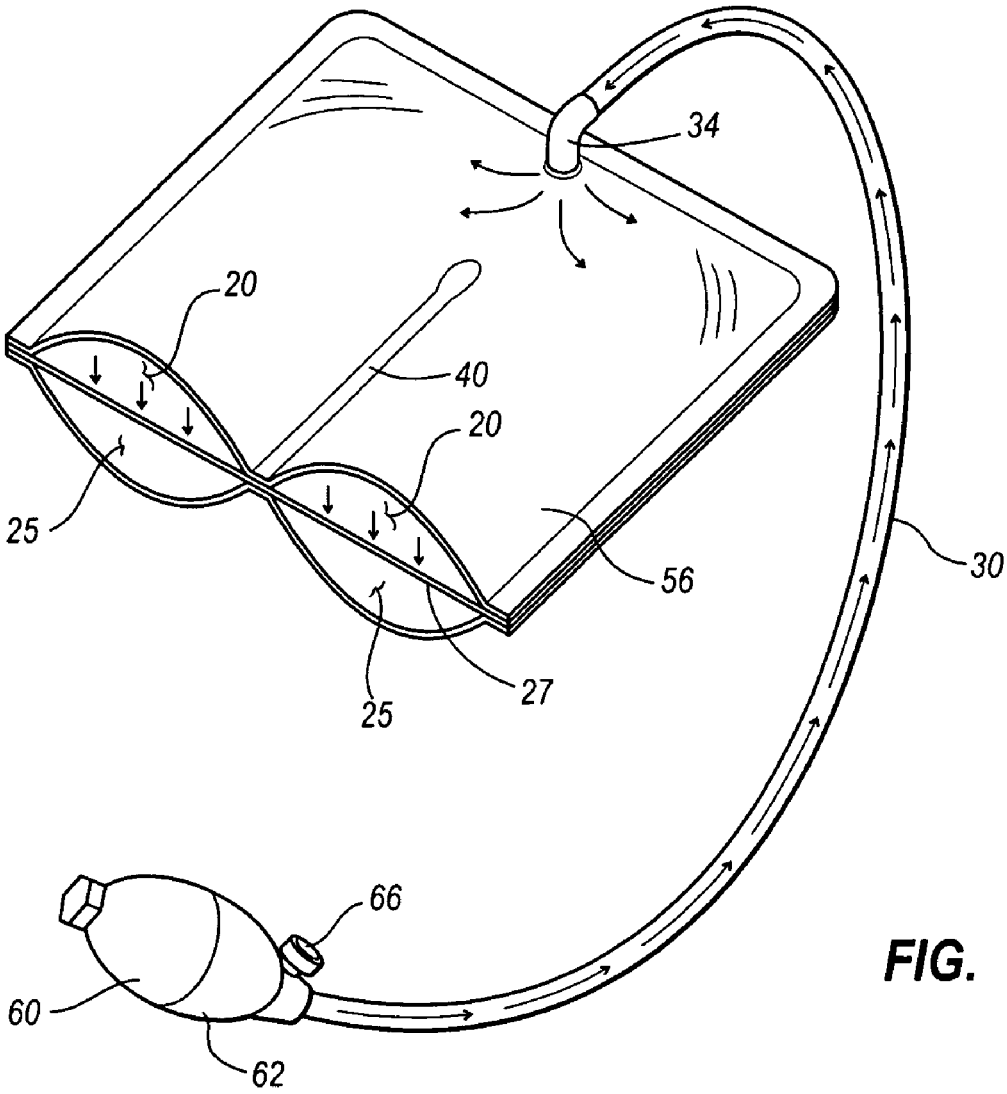
FIG. 3 is a cut-away view of the pressurizable fluid delivery system of FIG. 1.

As shown in FIG. 3, the pressurizable portion 20 of the pressurized fluid reservoir 56 can have an inlet 34 that can be coupled to the pressure inducer 60 to supply pressure to the pressurizable portion 20 of the pressurized fluid reservoir 56. A flexible tube 30 can be fluidly coupled between the pressure inducer 60 and the pressurizable portion 20. It will be appreciated that the flexible tube 30 can be coupled to any portion of the pressurizable portion 20. The flexible tube 30 can transmit a pressure supply from the pressure inducer 60 to the pressurizable portion 20 of the pressurized fluid reservoir 56.

The pressure inducer 60 can be a source of compressible gas, such as a hand or electric air pump, an air compressor, a blow tube, a carbon-dioxide gas cartridge, a tank filled with a noble gas such as krypton, argon, or helium, or mixtures and combinations of these and other gas based sources. For example, the pressure inducer 60 can be a manual pump including a compressible bulb 62. A relief and/or pressure limiting valve 66 can be coupled in line between the tube 30 and the compressible bulb 62 to allow release of the pressure in the pressurizable portion 20 of the pressurized fluid reservoir 56. In use, the compressible bulb 62 can be compressed by the user to pump air through the flexible tube 30, indicated by the arrows, and into the pressurizable portion 20 of the pressurized fluid reservoir 56, as illustrated by arrows shown within the flexible tube 30. The air can then inflate and pressurize the pressurizable portion 20, exerting a force on the walls of the pressurizable portion 20 (shown by arrows within the pressurizable portion 20) causing the inner wall 27 separating the pressurizable portion 20 and the fluid bladder portion 25 to flex toward the fluid bladder portion 25, pressurizing the fluid bladder portion 25. It will be appreciated that other types of hand pumps, such as bicycle pumps, or piston pumps can also be used, as well as common electrical pumps known in the art.

It will be appreciated that, when pressurized, the pressurizable portion 20 can expand to have a larger volume than the pressurizable portion 20 in an unpressurized state. Consequently, when the pressurizable portion 20 is pressurized, the expanded, the pressurizable portion 20 can press against the fluid bladder portion 25 and push the liquid in the fluid bladder portion 25 toward the outlet 36. In this way, the force of the pressure in the inflated or pressurized portion 20 can be transferred to the liquid inside the fluid bladder portion 25. Advantageously, higher pressure supplied to the pressurized portion 20 results in higher pressure in the liquid in the fluid bladder portion 25, and a more forceful release of liquid from the fluid bladder portion 25 when the valve 80 is opened.

In order to control the shape of the pressurized fluid reservoir 56 when the fluid bladder portion 25 is filled and/or the pressurized portion 20 is expanded, the pressurized fluid reservoir 56 includes a seam component 40 which runs substantially down a portion of the center of the pressurized fluid reservoir 56. The seam component 40 is typically comprised of a weld which bonds the exterior walls of the pressurized fluid reservoir 56 to the inner wall 27 of the pressurized fluid reservoir 56. One advantage of this configuration is that the seam component 40 causes the pressurized fluid reservoir 56 to maintain a flattened shape, even when the fluid bladder portion 25 is filled and/or the pressurized portion 20 is expanded.

Figure 4:
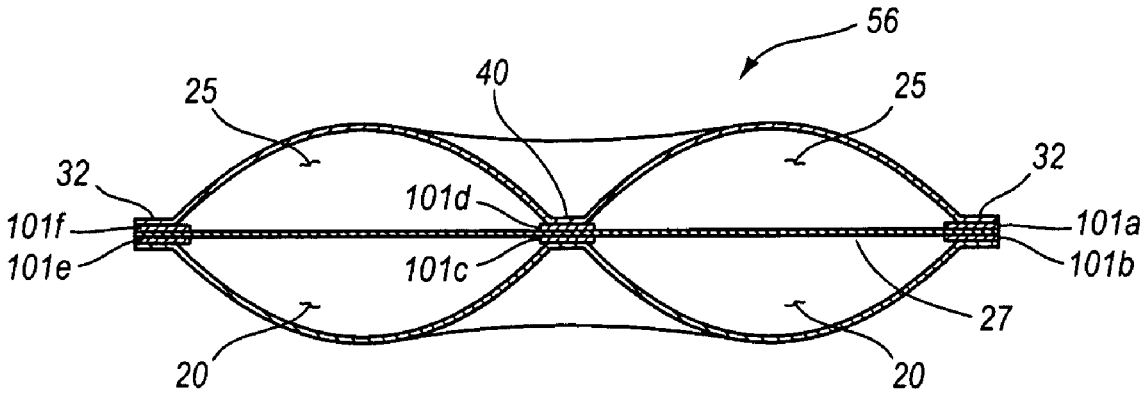
FIG. 4 is a cross section of an additional embodiment of the pressurizable fluid delivery system which includes reinforcements in the welds between the inflatable portion and the fluid bladder.

As shown in FIG. 4, the seams 32 and the seam component 40 may be formed with a reinforcing material portions 101*a*-101*e* formed along the seam 32 and seam component 40 so as to reinforce the seams 32 and the seam component 40.

Thus, one advantage of the present invention is a flexible system that is capable of retaining a flattened shape when in use. This is particularly useful in configurations where the pressurized fluid reservoir 56 is used in a backpack and the pressurized fluid reservoir 56 is disposed in the backpack along a user's back where rounded or unequally weighted objects may result in the user's discomfort.

Figure 5:
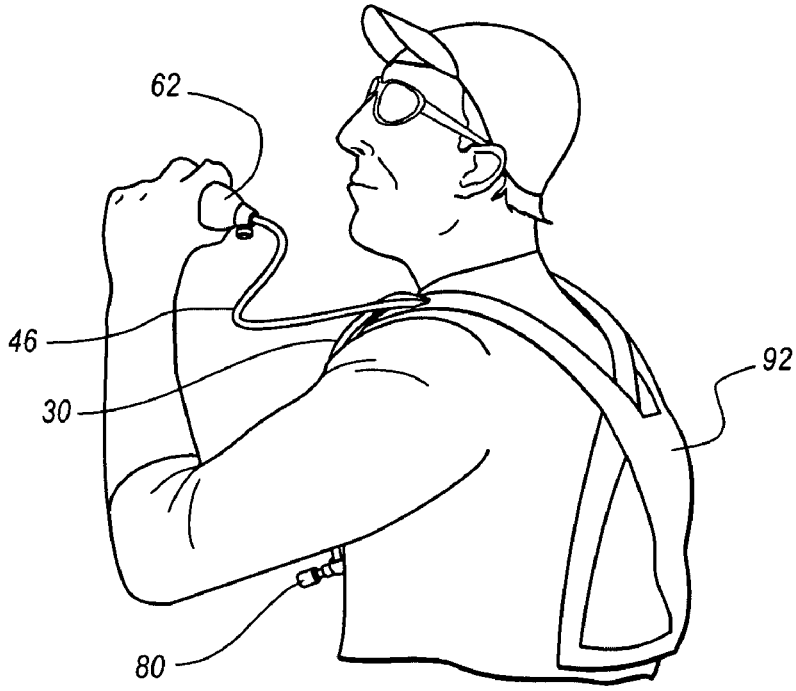
FIGS. 5 and 6 illustrate a method for pressurizing and dispensing liquid from a pressurizable fluid delivery system in accordance with an embodiment of the present invention.
Figure 6:
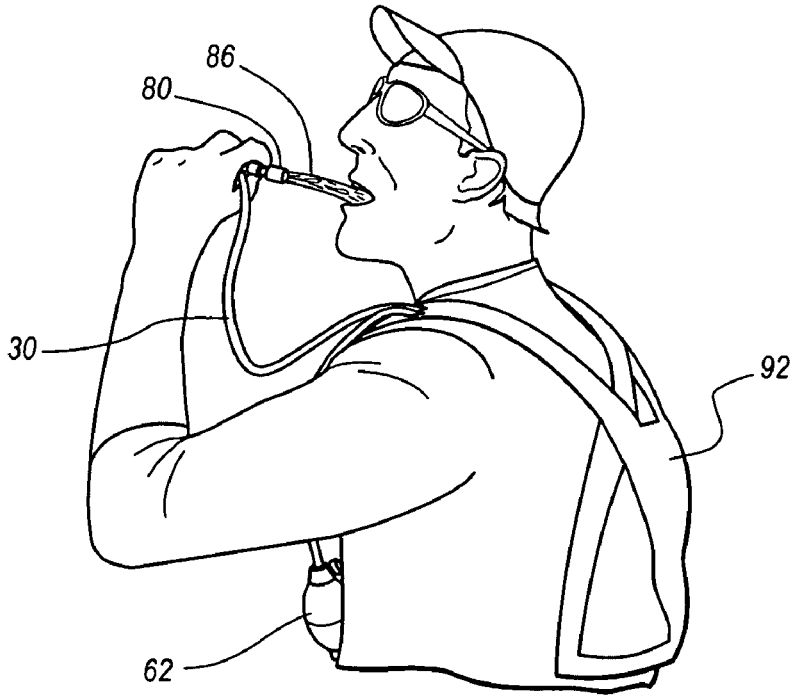

Returning to FIG. 1, the valve 80 can be positioned at an end of the flexible tube 46 so as to be positionable by the user of the pressurizable fluid delivery system 10 in an easily accessible position. The valve 80 can be a standard gate type valve, such as a ball valve, a compression valve, a T valve, or the like. For example, as shown in FIGS. 5 and 6, the valve 80 can be a compression valve that can be closed in an uncompressed configuration and open in a compressed configuration. The compression valve 80 can include a bite shroud 82 that can be placed between the teeth of the user so that the user can bite on the bite shroud to compress and open the compression valve 80. In this way, the compression valve 80 can be a bite valve or mouth valve that can allow hands free operation. Additionally, the shroud 82 can be compressed between the thumb and fingers of the user to open the compression valve 80, as shown in FIG. 6. In this way, the user can selectively open the valve 80 to release liquid from the pressurized fluid reservoir 56.

Advantageously, as shown in FIG. 6 the force of the pressure from the chamber 20 can push the liquid in the pressurized fluid reservoir 56 through the flexible tube 30 and out the valve 80 with sufficient force so as to create a projecting stream of liquid 86 that can project into the mouth of the user without having the valve 80 directly in the mouth of the user.

Additionally, it is a particular advantage of the present invention that the liquid can be forced by pressure from the tube as a pressurized, projected stream. Such a pressurized stream can be useful in many applications. For example, the projecting stream of liquid 86 can be used to wash and clean dirt and debris from shoes, bicycles, or other equipment employed by the user. The projecting stream of liquid 86 can also be used to create a mist of liquid that can be sprayed onto the user to cool and refresh the user, or a pet, or a partner that is engaged in strenuous activity. The projecting stream of liquid can also be used to fill another container or bowl. Additionally, the projected pressurized stream of liquid can be used to put out a fire, thereby allowing the present invention to be used as a light weight fire extinguisher.

In this way, the pressurizable fluid delivery system 10 can be used in any number of scenarios, including as a personal hydration device that can be placed in a pack such as a back pack, lumbar carry back, shoulder harness, cross-shoulder hardness, vest, toolbar, automobile or ATV mounted carrier, or fanny pack. As may be understood by one of ordinary skill in the art, the size and shape of the pressurizable fluid delivery system 10 may be modified depending on the specific pack or carrier configuration. Furthermore, embodiments of the invention may be integrated with and form a component of the pack.

Figure 7:
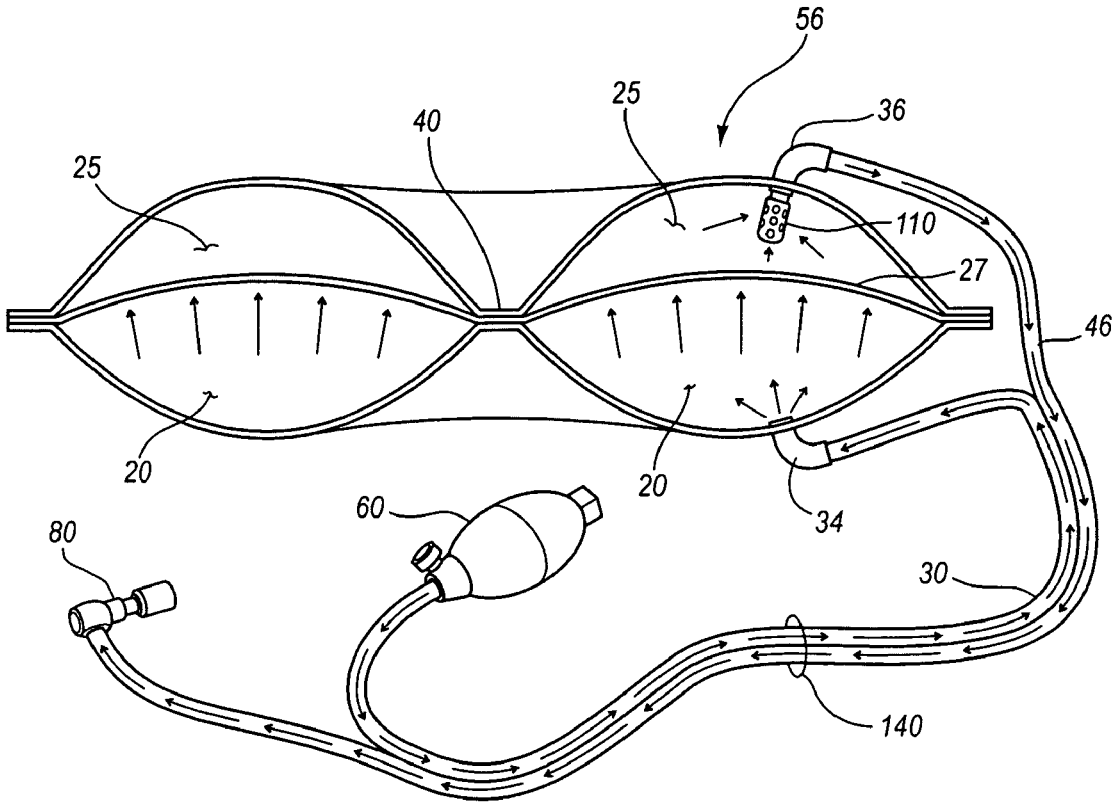
FIG. 7 is a cross section of a pressurizable fluid delivery system according to an alternative embodiment of the invention.

FIG. 7 illustrates various embodiments that may be made to the pressurizable fluid delivery system 10. As illustrated in FIG. 7, the flexible tube 46 coupled to the outlet 36 which carries liquid from the fluid bladder portion 25 and the flexible tube 30 coupled to the outlet 34 which transmits a pressure supply to the pressurized portion 20 may be joined together in at least portion of the flexible tube 46 and the flexible tube 30 to form a single bifurcated tube 140. One advantage of this configuration is that there is only one bifurcated tube 140 for the user to locate when he or she wishes to use the pressurizable fluid delivery system 10.

In an additional embodiment illustrate in FIG. 7, the outlet 36 of the fluid bladder portion 25 includes a cap 110 which includes a number of holes through with the fluid may pass into the outlet 36. One advantage of this embodiment is that the cap 110 prevents the inner wall 27 of the fluid bladder portion 25 from expanding so far into the fluid bladder portion 25 that the outlet 36 is sealed by the inner wall 27. More specifically, even in situations where the pressurized portion 20 is so pressurized that the inner wall 27 of the fluid bladder portion 25 flexes so far into the fluid bladder portion 25 that the inner wall 27 comes into contact with the outer wall of the fluid bladder portion 25, the cap 110 has holes in its side walls which enable fluid disposed on either side of the cap 110 to enter the outlet 36. Thus, the cap 110 ensures the continual flow of fluid out of the outlet 36, even in situations where the pressurized portion 20 is highly pressurized and there is only a small amount of fluid in the fluid bladder portion 25.

Figure 8:
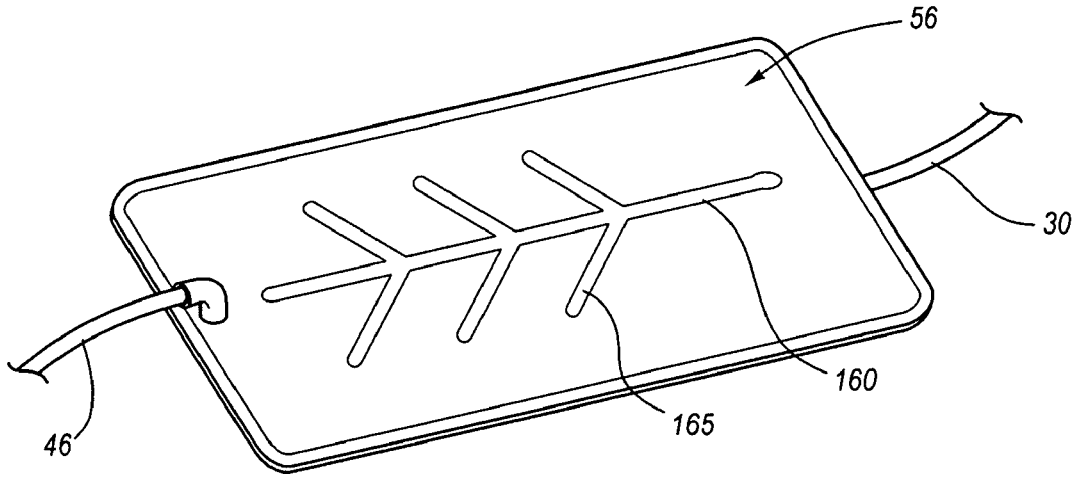
FIG. 8 is a perspective view of a pressurizable fluid delivery system in accordance with another alternative embodiment of the invention.

As may be understood by one of ordinary skill in the art, the specific shape or configuration of the seam component may be varied. In the embodiment described herein, the seam component 40 comprises a single line disposed in the center of the pressurized fluid reservoir 56 and extending in the lengthwise direction of the pressurized reservoir 56. Alternatively, the seam component may comprise a plurality of smaller seam components, such as a series of dots or small lines formed in the center of the pressurized fluid reservoir 56. As shown in FIG. 8, the seam component may also comprise a leaf or vein-like shape with a central portion 160 disposed in the center of the pressurized fluid reservoir 56 and extending in the lengthwise direction of the pressurized reservoir 56, with a series of extending portions 165 which extend away from the central portion 160 in the widthwise direction of the pressurized reservoir. Thus, the seam component 40 may comprise any number of different shapes and sizes without departing from the meaning and scope of the claimed invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A man-portable flexible fluid delivery system comprising:

a fluid bladder having a first inlet and a first outlet, the fluid bladder configured to contain liquid;

an inflatable component capable of being pressurized by inflation and having a second inlet, the inflatable component being formed adjacent to the fluid bladder, such that the fluid bladder and the inflatable component are integrated to form a pressurized fluid reservoir, the fluid bladder having a first exterior wall and the component having a second exterior wall with a common interior wall being shared between the fluid bladder and the inflatable component;

a seam element formed in a center portion of the fluid bladder and the inflatable component of the pressurized fluid reservoir, the seam element having an island shape which bonds the center portion of the fluid bladder and the inflatable component so as to control the shape of the pressurized fluid reservoir while allowing fluid on a first side of the seam element to communicate with fluid on a second side of the seam element, the seam element bonding the first exterior wall and second exterior wall to the common interior wall;

a pump associated with the second inlet of the inflatable component, the pump being configured to inflate the inflatable component of the pressurized fluid reservoir; and a valve operatively coupled to the first outlet of the fluid bladder, the valve being capable of releasing the liquid contained in the fluid bladder of the pressurized fluid reservoir.

2. The system of claim 1, wherein the inflatable component is inflatable with a gas.

3. The system of claim 2, wherein the gas is selected from the group consisting of air, compressed air, carbon-dioxide, compressed carbon dioxide, noble gases, and mixtures thereof.

4. The system of claim 1, wherein the pump is a manually operated pump to pump air into the inflatable component.

5. The system of claim 1, wherein the pump includes a compressed gas source configured to release compressed gas into the inflatable component to inflate the inflatable component.

6. The system of claim 1, wherein the valve is a compression valve configured to open under an applied compressive force.

7. The system of claim 6, wherein the valve includes a bite shroud and the compressive force is applied by a user's teeth.

8. The system of claim 1, wherein the seam element comprises a line located in approximately the center of the pressurized fluid reservoir which extends in the direction of the length of the pressurized fluid reservoir.

9. The system of claim 1, wherein the seam element comprises a plurality of seam elements which are aligned in approximately the center of the pressurized fluid reservoir so as to extend in the direction along the length of the pressurized fluid reservoir.

10. The system of claim 1, wherein the seam element comprises a leaf-shaped seam located in approximately the center of the pressurized fluid reservoir.

11. The system of claim 1, wherein the system comprises a system for use as a hydration system for a human or a pet, a cooling system for a human, pet, piece of equipment, or fire, or a cleaning system for a human, pet, or piece of equipment.

12. A man-portable pressurized fluid reservoir configured to hold and selectively dispense a liquid through an outlet comprising:

a bladder portion configured to contain a liquid and having a first inlet capable of receiving the liquid and an outlet capable of dispensing the liquid;

an inflatable portion formed adjacent to the bladder portion, the inflatable portion having a second inlet capable of receiving a gas so as to inflate and apply a pressure on the bladder portion formed adjacent to the inflatable portion, the bladder portion having a first exterior wall and the inflatable portion having a second exterior wall with a common interior wall being shared between the bladder portion and the inflatable portion;

a seam element formed in a center portion of the bladder portion and inflatable portion, the seam element having an island shape which bonds the center portion of the bladder portion and the inflatable portion so as to control the shape of the bladder portion and the inflatable portion while allowing fluid on a first side of the seam element to communicate with fluid on a second side of the seam element, the seam element bonding the first exterior wall and second exterior wall to the common interior wall;

a pressure inducer associated with the second inlet of the inflatable portion being configured to inflate the inflatable portion by transferring a gas into the inflatable portion via the second inlet; and a valve operatively coupled to the first outlet of the bladder portion, to the valve being capable of releasing the liquid contained in the fluid bladder portion.

13. The pressurized fluid reservoir of claim 12, wherein the seam element is configured to maintain a flattened shape in the pressurized fluid reservoir as the inflatable portion is inflated.

14. The pressurized fluid reservoir of claim 12, wherein the inflatable portion is inflatable with a compressible gas.

15. The pressurized fluid reservoir of claim 14, wherein the pressure inducer comprises a pump configured to pump a compressible gas into the pressure chamber to inflate the pressure chamber.

16. The pressurized fluid reservoir of claim 12, wherein the outlet capable of dispensing the liquid from the bladder portion includes a cap capable of preventing a wall of the inflatable portion from sealing the outlet of the bladder portion closed.

17. The pressurized fluid reservoir of claim 12, wherein the seam element comprises a line located in approximately the center of the pressurized fluid reservoir which extends in the direction of the length of the pressurized fluid reservoir.

18. The pressurized fluid reservoir of claim 12, wherein the seam element comprises a plurality of seam elements which are aligned in approximately the center of the pressurized fluid reservoir so as to extend in the direction along the length of the pressurized fluid reservoir.

19. The pressurized fluid reservoir of claim 12, wherein the seam element comprises a leaf-shaped seam located in approximately the center of the pressurized fluid reservoir.

20. A man-portable flexible fluid delivery system, comprising:

a fluid bladder having a first inlet and a first outlet, the fluid bladder configured to contain liquid an inflatable component capable of being pressurized by inflation and having a second inlet, the inflatable component being formed adjacent to the fluid bladder, such that the fluid bladder and the inflatable component are integrated to form an pressurized fluid reservoir, the fluid bladder having a first exterior wall and the inflatable component having a second exterior wall with a common interior wall being shared between the fluid bladder and the inflatable component;

a seam element formed in a center portion of the fluid bladder and the inflatable component of the pressurized fluid reservoir, the seam element having an island shape which bonds the center portion of the fluid bladder and the inflatable component so as to control the shape of the pressurized fluid reservoir while allowing fluid on a first side of the seam element to communicate with fluid on a second side of the seam element, the seam element bonding the first exterior wall and second exterior wall to the common interior wall;

a pump associated with the second inlet of the inflatable component, the pump being configured to inflate the inflatable component of the pressurized fluid reservoir; and a valve operatively coupled to the first outlet of the fluid bladder, the valve being capable of releasing the liquid contained in the fluid bladder of the pressurized fluid reservoir, wherein the fluid bladder and the inflatable component are separated by a membrane wall, such that the membrane wall forms a wall of the fluid bladder and a wall of the inflatable component.

* * * * *